US009217119B2

(12) United States Patent
Feng et al.

(10) Patent No.: US 9,217,119 B2
(45) Date of Patent: Dec. 22, 2015

(54) EXTRACTION OF LIPIDS FROM LIVING CELLS UTILIZING LIQUID $CO_2$

(75) Inventors: Maoqi Feng, San Antonio, TX (US); Darius D. Daruwalla, San Antonio, TX (US); Jimell Erwin, San Antonio, TX (US); W. Kennedy Gauger, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 927 days.

(21) Appl. No.: 13/305,558

(22) Filed: Nov. 28, 2011

(65) Prior Publication Data

US 2013/0137886 A1 May 30, 2013

(51) Int. Cl.
*C11B 1/10* (2006.01)

(52) U.S. Cl.
CPC ..... *C11B 1/104* (2013.01)

(58) Field of Classification Search
USPC ..... 435/243
See application file for complete search history.

(56) References Cited

U.S. PATENT DOCUMENTS

| | | | | |
|---|---|---|---|---|
| 5,539,133 | A | 7/1996 | Kohn | |
| 7,205,284 | B2 | 4/2007 | Pasco et al. | |
| 8,148,559 | B1 * | 4/2012 | Walker et al. | 554/82 |
| 2005/0051194 | A1 * | 3/2005 | Sakashita et al. | 134/21 |
| 2007/0059317 | A1 | 3/2007 | ElSohly | |
| 2007/0264271 | A1 | 11/2007 | ElSohly | |
| 2008/0188676 | A1 * | 8/2008 | Anderson et al. | 554/21 |
| 2010/0330658 | A1 * | 12/2010 | Fleischer et al. | 435/257.1 |
| 2011/0083360 | A1 * | 4/2011 | Poenie et al. | 44/307 |
| 2011/0095225 | A1 | 4/2011 | Eckelberry | |
| 2014/0004605 | A1 * | 1/2014 | Donohue et al. | 435/410 |

FOREIGN PATENT DOCUMENTS

| | | |
|---|---|---|
| WO | 9325644 | 12/1993 |
| WO | 0204000 | 1/2002 |
| WO | 2010090506 | 8/2010 |
| WO | 2011133181 | 10/2011 |

OTHER PUBLICATIONS

Mendes et al., Supercritical carbon dioxide extraction of compounds with pharmaceutical importance from microalgae, Inorganica Chimica Acta, 356; 328-334, 2003.*

Moreira et al., Immobilization of the marine microalga *Phaedactylum tricornutum* in alginate for insitu experiments: Bead stability and suitability, Enzyme and Microbial Technology, 38, 2006, pp. 135-141.*

Rooke et al., Targeting photobioreactors: Immobilization of cyanobacteria within porous silica gel using biocompatible methods, J. Mater. Chem., 2008, 18, pp. 1333-1341.*

Crampon et al., Supercritical Carbon Dioxide Extraction of Molecules of Interest from Microalgae and Seaweeds, I&EC, Jun. 20, 2011.*

Price et al., Preparation and Chemistry of the Artificial Algal Culture Medium Aquil, Biological Oceanography, vol. 6, pp. 443-461.*

Beckman, "Supercritical and near-critical CO2 in green chemical synthesis and processing," J. of Supercritical Fluids 28 (2004) 121-191.

Hejazi, et al., "Milking of microalgae," TRENDS in Biotechnology vol. 22 No. 4 Apr. 2004 pp. 189-194.

Frenz, et al, "Hydrocarbon recovery by extraction with a biocompatible solvent from free and immobalized cultures of *Botryococcus braunii*," Enzyme Microb. Technol., 1989, vol. 11, November pp. 717-724.

Sauer, et al., "Bacterial Milking: A Novel Bioprocess for Production of Compatible Solutes," Biotechnol Bioeng. Feb. 5, 1998;57(3):306-13.

Hejazi, et al., "Selective Extraction of Carotenoids from the Microalga Dunaliella salina with Retention of Viability," Biotechnol Bioeng. Jul. 5, 2002;79(1):29-36.

Hejazi, et al., "Milking Microalga Dunaliella salina for β-carotene production in two-phase bioreactors," Biotechnology and Bioengineering, vol. 85, Issue 5, pp. 475-481, Mar. 5, 2004.

Dragone, et al., "Third Generation Biofuels from Microalgae," Applied Microbiology (2010) pp. 1355-1366.

Tisi, et al., "Effect of Dense Phase Carbon Dioxide on Enzyme Activity and Casein Proteins in Raw Milk," Graduate Thesis, Jan. 2004, available at http://hdl.handle.net/1813/60.

Moroney, et al., "Algal Carbon Dioxide Concentrating Mechanisms," Journal of Bacteriology (2007) Publisher: John Wiley & Sons, Ltd, pp. 1-7.

Rizvi, "Supercritical Fluid Extraction: Operating Principles and Food Applications," Food Technology, Jul. 1986. v. 40 pp. 57-64.

Harun, et al., "Bioprocess engineering of microalgae to produce a variety of consumer products," Renewable and Sustainable Energy Reviews, vol. 14, Issue 3, Apr. 2010, pp. 1037-1047.

Rooke, et al., "Novel photosynthetic CO2 bioconvertor based on green algae entrapped in low-sodium silica gels," J. Mater. Chem., 2011,21, 951-959.

Avnir, et al., "Recent bio-applications of sol-gel materials," J. Mater. Chem., 2006, 16, 1013-1030.

Rooke, et al., "Energy from photobioreactors: Bioencapsulation of photosynthetically active molecules, organelles, and whole cells within biologically inert matrices," Pure Appl. Chem., vol. 80, No. 11, pp. 2345-2376, 2008.

Meunier, et al., "Investigation of different silica precursors: Design of biocompatible silica gels with long term bio-activity of entrapped thylakoids toward artificial leaf," J. Mater. Chem., 2009,19, 4131-4137.

Meunier, et al., "Encapsulation of cells within silica matrixes: Towards a new advance in the conception of living hybrid materials," Journal of Colloid and Interface Science 342 (2010) 211-234.

Dixon, et al, "A Review: The inhibition by CO2 of the growth and metabolism of micro-organisms," Journal of Applied Bacteriology 1989, 67, 109-136.

Ballestra, et al., "Inactivation of *Escherichia coli* by Carbon Dioxide under Pressure," Journal of Food Science, vol. 61, No. 4, 1996 pp. 829-831.

Dillow, et al., "Bacterial inactivation by using near- and supercritical carbon dioxide," Proc. Natl. Acad. Sci. USA vol. 96, pp. 10344-10348, Aug. 1999.

Mercer, et al., "Developments in oil extraction from microalgae," Eur. J. Lipod Sci. Technol. 2011, 113, 539-547.

* cited by examiner

*Primary Examiner* — Taeyoon Kim
*Assistant Examiner* — Srikanth Patury
(74) *Attorney, Agent, or Firm* — Grossman, Tucker et al.

(57) ABSTRACT

A process for the extraction of lipids from living cells utilizing liquid carbon dioxide optionally in the presence of a porous inorganic matrix or polymer coating as well as additional solvents to improve extraction efficiency. The cells may also optionally be treated a photosensitive material to promote cellular photosynthesis.

16 Claims, 3 Drawing Sheets

EXTRACTION OF LIPIDS FROM LIVING CELLS UTILIZING LIQUID $CO_2$

FIELD OF THE INVENTION

The present invention is directed at the extraction of lipids from living cells utilizing liquid carbon dioxide ($CO_2$) optionally in the presence a porous inorganic matrix or polymer coating as well as additional solvents to improve extraction efficiency. The present invention also provides the ability to strengthen the cells during the extraction process and/or employ photo-sensitive additives to improve the efficiency of cellular photosynthesis.

BACKGROUND

Microalgae are microscopic algae typically found in freshwater and marine systems. They are unicellular species which range from a few microns to a few hundred microns. Microalgae have also been identified as promising candidates for biodiesel fuel production and bio-based products because of their advantages of higher photosynthetic efficiency and faster growth compared to other energy crops, which accumulates a satisfactory amount of lipid for biodiesel production. However, microalgae harvesting still constitutes about 50% of the total cost for biofuel production from microalgae. Furthermore, a significant bottleneck in the application of microalgae for bio-based product development is the relatively low productivity of the culture. One fundamental reason for this is slow cell growth rates may be due to relative inefficient use of strong light.

The extraction of products from microalgae had been reported in literature. For example, Frenz et al. collected a substantial fraction of hydrocarbons (hydrophobic hydrocarbons) from microalga *Botryococcus braunii* (*B. braunii*) by exposing the cells to hexane for a short time. Frenz, J., et al, "*Hydrocarbon Recovery By Extraction With A Biocaompatible Solvent From Free And Immobilized Cultures of Botryococcus Braunii*", Enzyme Microb. Technol. 1989, 11 717-724. In this method, the cells were harvested, separated and then contacted with the organic phase for extraction, and then the cells were returned to the bioreactor.

Sauer et al. applied a milking technique for the production of ectoines from the halophilic bacterium Halomonas elongata. Sauer et al, Bacterial Milking: *A Novel Bioprocess For Production Of Compatible Solutes*, Bioeng. 1998, 57, 306-313. Ectoines were biosynthesized in high salinity media. The cells were then transferred to a medium with low salinity and the ectoines were extracted. However, they did not compare productivity of the milking process with existing processes.

Recently, a new method was reported for milking β-carotene (a lipid) from *Dunaliella salina* in a two-phase bioreactor. Hejazi, M. A. et al. *Selective Extraction of Carotenoids From The Microalga Dunaliella Salina With Retention of Viability*. Biotechnol. Bioeng. 2002, 79, 29-36; Hejazi, M. A. et al. *Milking Microalga Dunaliella Salina For β-carotene Production In Two-Phase Bioreactors*, Biotechnol. Bioeng. 2004, 85, 475-481. In this method, cells are first grown under normal growth conditions and then stressed by excess light to produce larger amounts of β-carotene. At this stage, a biocompatible organic phase is added and the β-carotene is extracted selectively via continuous re-circulation of a biocompatible organic solvent through the aqueous phase containing the cells.

In open pond cultivation, at water depths of 0.15-0.20 meters, microalgae biomass concentrations are up to 1 g/L and productivities of 10-25 $g/m^2 \cdot d$. Giuliano Dragone, Bruno Fernandes, António A. Vicente, and José A. Teixeira, *Third Generation Biofuels From Microalgae*, Current Research, Technology and Education Topics in Applied Microbiology and Microbial Biotechnology, A. Mendez-Vilas (Ed.), 2010, pp 1355. Given the relatively low biomass concentration (typically in the range of 1-5 g/L) obtainable in microalgae cultivation systems due to the limit of light penetration, solvent loss when scaling up and efficiency are two major concerns for this method. Organic solvents are detrimental to environment, and recycling of the extraction solvent is energy intensive.

SUMMARY OF THE INVENTION

The present invention relates to a process for extracting lipids from cells comprising supplying living cells containing lipids to an extractor and extracting said lipids from said cells with liquid and/or supercritical carbon dioxide medium, wherein said liquid $CO_2$ is at or above 216.5° K and 517 kPa and wherein said supercritical $CO_2$ is at or above 304.2° K (31.1° C.) and 7.39 MPa. The extraction may be made continuous and the release of $CO_2$ pressure may be sequenced to reduce cellular destruction. The cells may be coated with a porous inorganic material such as a silica gel coating or a porous hydrophilic polymer. The polarity of the extraction medium may be modified by the incorporation of an organic solvent. One may also treat the living cells with a photosensitive material to promote cellular photosynthesis.

LIST OF FIGURES

The above-mentioned and other features of this disclosure, and the manner of attaining them, will become more apparent and better understood by reference to the following description of embodiments described herein taken in conjunction with the accompanying drawings, wherein.

DETAILED DESCRIPTION

In one embodiment, the present disclosure is directed at a process for extracting lipids form living cells utilizing liquid $CO_2$. The living cells may preferably comprise any microalgae whose habitat is fresh water, sea water or brackish water, that may be cultivated in open-field ponds, utilizing sunlight. Preferably, the living cells may include but not be limited to *Nanochloropsis oculata, Chlamydomonas, Spirogyra, Euglena, Prymnesium, Porphyridium, Synechoccus* sp, *Cyanobacteria, Botryococcus braunii, Chlorella vulgaris*, and *Scenesdesmus*. The size of the cells may preferably fall in the range of 2-20 μm in diameter. The algae may therefore be phototrophic bacteria grown in an open natural environment or in a closed environment. The methods of the invention can also be used to extract lipids from heterotrophic bacteria.

As noted, the present disclosure utilizes liquid $CO_2$ as an extraction medium. As may be appreciated, the use of liquid $CO_2$ is such that it provides an environmentally benign solvent. In addition, one advantage of $CO_2$ extraction over conventional organic solvent extraction is that no subsequent processing steps are required to separate the solvent, as $CO_2$ is a gas at room temperature and pressure. As applied to the extraction of living cells herein, an additional advantage is that organic solvent extraction processes produce extracts containing materials that are generally susceptible to oxidation and subsequent separation of these solvents may promote the degradation of the compounds of interest.

Figure 1:
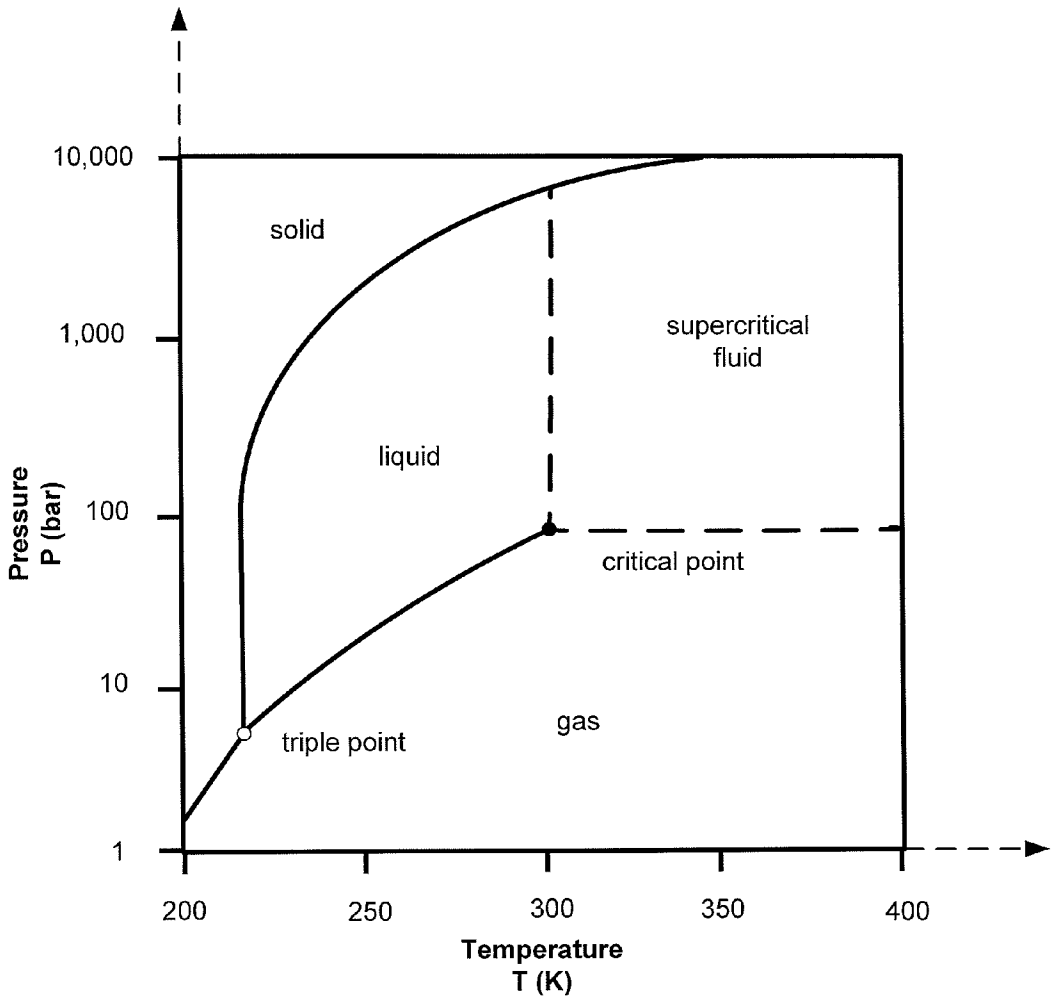
FIG. 1 is a phase diagram of $CO_2$.

Reference to liquid $CO_2$ herein may therefore be understood as the liquid and/or supercritical regions of the $CO_2$ phase diagram shown in FIG. 1. As illustrated therein, $CO_2$ may be in the form of a liquid or supercritical fluid. The triple point of $CO_2$ is 216.5° K (−56.6° C.) and 517 kPa. The critical point is 304.3° K (31.1° C.) and the critical pressure is 72.9 atm or 7.39 MPa. The $CO_2$ that may be employed herein may therefore fall within the range of liquid $CO_2$ and/or supercritical $CO_2$ as defined above and as illustrated in FIG. 1 in the regions "liquid" or "supercritical fluid." That is liquid $CO_2$ is at or above 216.5° K and 517 kPa and supercritical $CO_2$ may be at or above 304.3° K (31.1° C.) and 7.39 MPa.

$CO_2$ is a preferred solvent herein due to its relatively low critical temperature (31.1° C.) and pressure. At these states the $CO_2$ alters its physical properties by increasing its density and becomes a more effective solvent for the extraction disclosed herein. The liquid $CO_2$ herein may also provide relatively decreased viscosity (50-100 μPa-s) and increased diffusivity (0.01-1 $mm^2/s$) thereby facilitating penetration and extraction through a cell membrane.

Furthermore, the liquid $CO_2$ herein may be used on its own and optionally, in combination with other solvents. For example, one may utilize liquid $CO_2$ in combination with up to 15.0% by weight of an organic co-solvent, preferably an organic alcohol (ROH) and/or organic ether (R—O—R) wherein R is an alkyl group or substituted alkyl group. Accordingly, one may utilize methanol, ethanol, propanol, butanol and/or dimethyl ether (DME). Preferably, one may select one or more of such optional solvents in order to increase the relative polarity of the $CO_2$ extraction medium. For example, in the case of dimethyl ether, the polarity of the mixture of liquid $CO_2$ and dimethyl ether may be increased and the viscosity is also altered. This results in an increase in the extraction medium solvating power and in turn, the extraction of the living cells herein may be achieved at relatively lower pressure and temperature (provided the $CO_2$ is maintained in its liquid state). In addition, such optional co-solvents are selected such that they are also readily separated from the extract. For example, DME has a boiling point of −25.1° C. at 1 atm and the critical point of DME is 127° C. at 5.24 MPa. After extraction of the microalgae the DME may be readily vaporized at ambient temperature and separated from the medium while $CO_2$ remains in the liquid phase.

Expanding upon the above, it may be appreciated that the relative polarity of $CO_2$ is low while DME is a relatively polar solvent. The relative static permittivity or dielectric constant of a solvent therefore becomes useful to quantify polarity. The relative permittivity of $CO_2$ was therefore observed to be increased by incorporation of a relatively polar solvent. For example, carbon dioxide exhibits a dielectric constant of 1.5 in the liquid state and supercritical $CO_2$ will exhibit values between 1.1 and 1.5 depending upon density. DME has a dielectric constant of 5.02. The combination of DME with $CO_2$ herein will therefore lead to an overall increase in the dielectric constant of the extraction medium to further improve lipid extraction. Accordingly, the organic solvent that may be selected herein to be combined with the supercritical $CO_2$ may be one that preferably has a dielectric constant of greater than 1.5.

With regards to viscosity considerations, the dynamic viscosity of supercritical $CO_2$ (31.1° C., 7.39 MPa) is about 60.5 μPa·s and the kinematic viscosity is 0.159 $mm^2/s$ (cSt). The representative DME solvent viscosity is 0.184 $mm^2$ at 25° C. Accordingly, the viscosity of the extraction medium-containing liquid or supercritical $CO_2$ may be increased herein for the extraction of the lipids from the cells by combining the liquid and/or supercritical $CO_2$ with an appropriate solvent.

Figure 2:
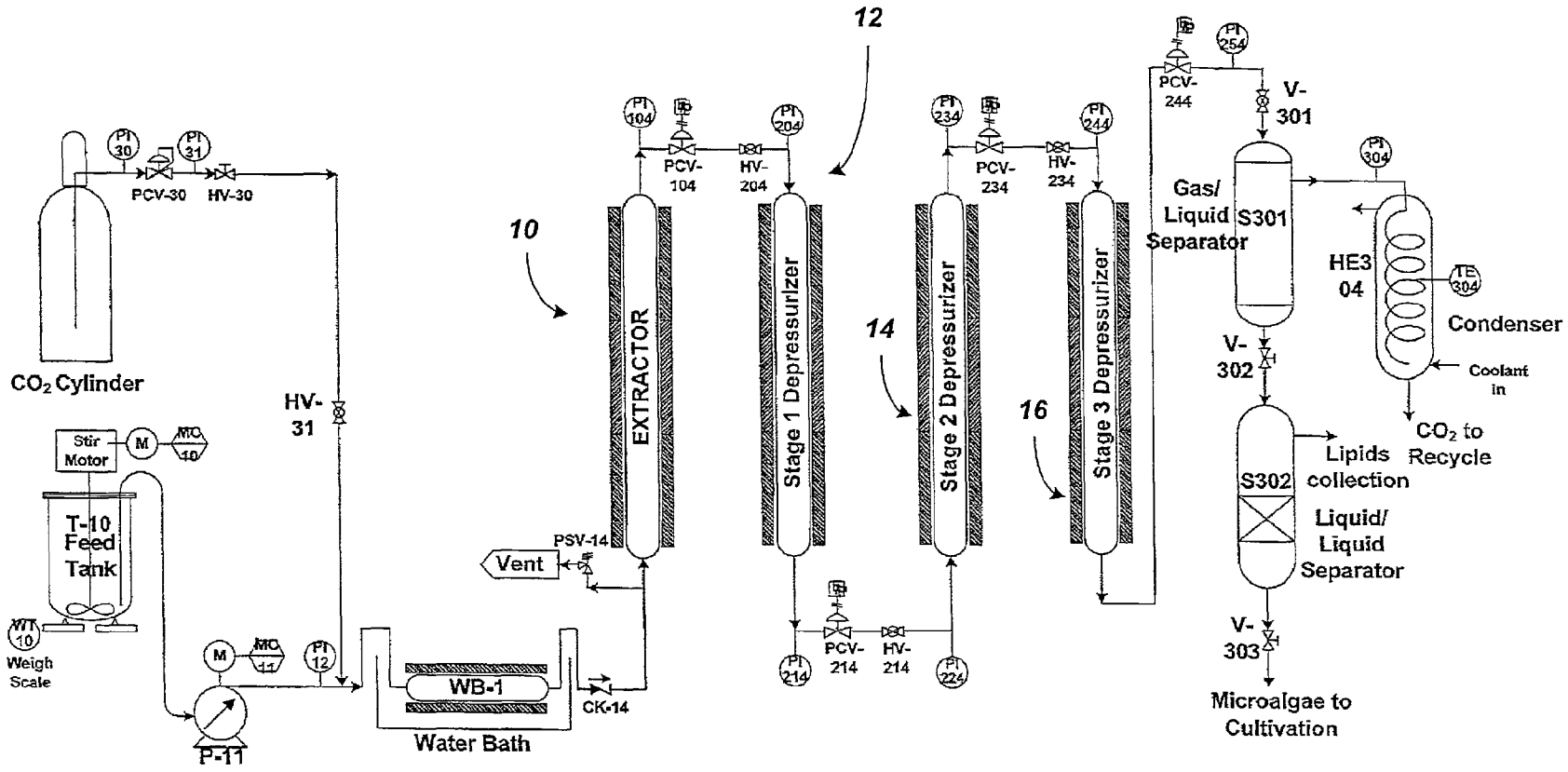
FIG. 2 illustrates one preferred configuration for the continuous extraction of living cells utilizing liquid $CO_2$.
Figure 3:
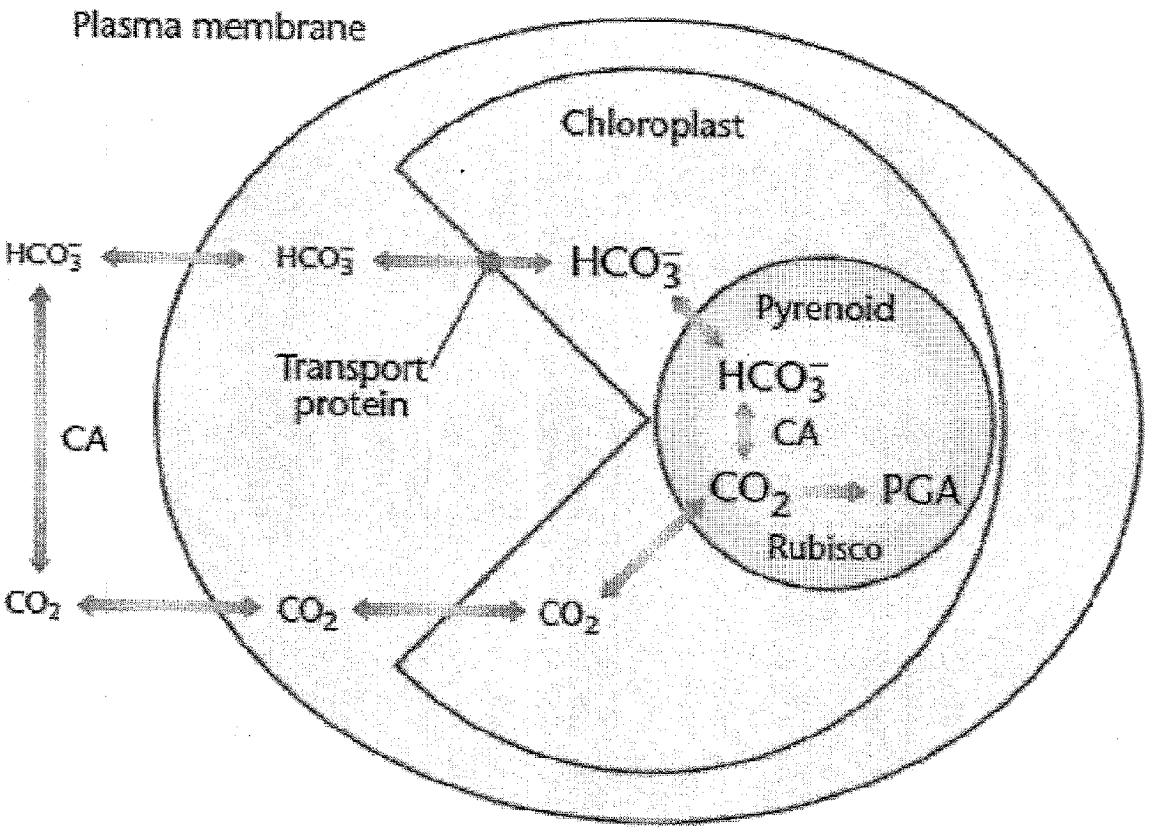
FIG. 3 illustrates CO2 interaction with eukaryotic algae.

It should also be noted that $CO_2$ herein has the additional benefit that it is useful for microalgae cultivation. Attention is directed to FIG. 2 which illustrates the model of $CO_2$ interaction with eukaryotic algae. In FIG. 2 "CA" is reference to carbonic anhydrase, "PGA" is 3-phosphoglyceric acid. The unicellular alagal cell has chloroplasts with a single pyrenoid. Chlorophyl thylakoid carbonic anhydrase plays an important role in the $CO_2$ concentrating mechanism of *C. reinhardtii*. The role of the pyrenoid is to provide a location for the generation of $CO_2$ in the presence of ribulose-1,5-bisphosphate carboxylase oxygenase (Rubisco). The thylakoid carbonic anhydrase catalyses the interconversion of hydrogencarbonate to $CO_2$ and results in a high local concentration of $CO_2$ which Rubisco can use before it has a chance to leak out of the cell. The concentrations of hydrogencarbonate and $CO_2$ within the chloroplast are higher than in the external environment. As dense phase $CO_2$ will generally penetrate cell walls at a higher relative rate than in its gaseous state, the liquid or supercritical $CO_2$ herein will therefore more quickly disperse through the microalgae cell wall for microalgae cultivation.

Lipids herein recovered from extraction may be understood to include a diverse group of organic compounds that are insoluble in water. Lipids may therefore include what is generally understood to be fats, e.g. triesters of glycerides and any of the several fatty acids (a carboxylic acid with a relatively long aliphatic tail which may be saturated or unsaturated with the number of carbon atoms ranging from 4-28). Lipids may also include waxes with melting points above 45° C., sterols, fat-soluble vitamins such as vitamins A, D, E and K, monoglycerides, diglycerides, triglycerides, and phospholipids. The lipids may be either hydrophobic or amphiphilic.

Preferably, cell death is avoided during the extraction procedures herein. More specifically, it may be appreciated that when, as noted above, liquid $CO_2$ is utilized as opposed to supercritical $CO_2$ the conditions that the living cells are exposed to are now relatively less severe and the proportion of cell death may be lowered during extraction.

To further improve the ability to extract lipids one may first treat the microalgae cells with porous inorganic matrix such as a porous silica gel coating (—$SiO_2$—). The porous silica may provide an immobilizing matrix for the cells and its porosity is such that it will allow for nutrient media and gases to permeate throughout its supporting structure. It is also optically transparent which enables light-energy to penetrate thereby allowing photosynthesis to continue. The porous silica is also chemically inert and may have pores sizes in the range of 5 Angstroms to 3,000 Angstroms (0.5 nanometers to 300 nanometers). It should also be noted that preferably, for freshwater microalgae, one may use a silica gel with relatively low concentration of sodium (e.g., at or below an atomic concentration of Na of 2.5%).

One may also improve lipid extraction ability by initially treating with a porous hydrophilic polymer. Reference to hydrophilic may be understood as a polymer that has polar groups that will interact with water. For example, one may preferably employ poly(ethylene glycol), polylactic acid (PLA), polylactic-co-glycolic acid (PLGA), chitosan, dextran and/or sodium alginate. The polymers may similarly have pore sizes in the range of 0.5 nanometers to 300 nanometers and the porosity may be present at a level of 40-60% by volume.

The porous silica gel coating and/or the porous polymer coating may be applied such that the coating of the cells is preferably in the range of 0.1 μm to 1.0 μm. More preferably, the coating thickness may be in the range of 0.1 μm to 0.5 μm. The coating is therefore preferably applied in a manner to the cells such that it will also allow for light to penetrate the coating so that photosynthesis will be allowed to continue and the porosity is such that it will allow nutrient media and extraction fluid to permeate.

By way of representative example, the silica coating can be applied according to the following general procedure: Silica coating: at 4° C., a solution of $H_2SiO_3$ is prepared by passing a sodium silicate solution of 1.0 M concentration over an acid ion exchange resin (e.g., Amberlite IR 120). Subsequently, 0.1 M KOH solution was added to the $H_2SiO_3$ solution until the pH reaches 6. Microalgae cells are then added to the $H_2SiO_3$ solution immediately. After 15 minutes, the microalgae cells coating process is completed.

It should be noted that when $CO_2$ dissolves in aqueous solution during the extraction procedure herein, and permeates the cell membrane, a portion may react with water to form carbonic acid:

$$CO_2+H_2O \rightarrow H_2CO_3 \rightarrow H^+ + HCO_3^-$$

The presence of carbonic acid might otherwise damage the microalgae cells. However, the application of the above referenced silica gel has the additional capability of adjusting the internal pH (actually it increases the interstitial pH) by forming metasilicic acid ($H_2SiO_3$) or silicic acid ($H_4SiO_4$). This then will reduce the damage to the microalgae cells during the extraction protocols disclosed herein.

One may also preferably add photosensitive materials with the porous silica and/or porous polymer during the cellular coating process to facilitate microalgae photosynthesis. The photosensitive materials may comprise any compound that will promote cellular photosynthesis and may therefore preferably comprise chlorophylls, iron porphyrins, algae pigments (carotenoids or phycobilins) and organic dyes. The preferred concentration of such photosensitive materials in the microalgae cells may be at a level of 500 ppm to 3,000 ppm.

Preferably, the extraction procedure herein is configured such that it may be accomplished in a continuous manner wherein the living cells, once extracted, and permitted to undergo further cultivation and subsequent extraction of additional lipid compounds. Attention is directed to FIG. 2. The following captions in FIG. 2 may be understood as follows:

PI-12, 30, 31, 104, 204, 214, 224, 234, 244: pressure indicators
HV-31, 204, 214: high pressure valves.
PCV-214, 234, 244: pressure control valves
PSV-14: pressure safety valve (pressure rupture disk)
HE-304: heat exchanger (condenser)
CK-14: check valve
TE-304: temperature indicator (thermocouple)
V-301, 302, 303: valves With attention to FIG. 2, it is noted that liquid $CO_2$ is charged into a high pressure liquid pump and compressed to the desired pressure. The operating pressure may be controlled by adjusting the back pressure regulator. At 10 is illustrated a tubular extraction column. Three fractionation cells or depressurizers (12, 14, and 16) are then employed which allow for relatively slow pressure release to avoid cell damage. Pressure on each of the depressurizers 12, 14 and 16 may be adjusted with a back pressure regulator at the end of each column, with the pressure setpoint set to decrease at a selected interval. Upon exiting the final depressurizer 16 the mixture flows to a gas/liquid separator tank where undissolved $CO_2$ may be flashed off the extracted lipids. The $CO_2$ may be recycled. The lipids may be collected from a liquid/liquid separator and the microalgae may then be transferred for additional cultivation and extraction.

With regards to the use of depressurizers, it should be noted that when extraction begins with supercritical $CO_2$ the $CO_2$ is at or above 304.3° K and 7.39 MPa. In the first depressurizer the pressure may be lowered to 4-5 MPa, thereby providing an initial pressure drop in the range of 30%-50%. This may then be followed by a second step of depressurization, where the pressure is lowered to 2-3 MPa. This represents a drop from the initial pressure of about 60%-70%. In the third depressurizes the pressure may then be dropped to atmospheric pressure, thereby provide a drop from the initial pressure of 80%-100%. Accordingly, it is preferred to avoid a rapid pressure drop and loss of supercritical pressure all at one time and the pressure drop that may be employed to avoid cell damage is one that is preferably sequenced wherein successive portions of the critical pressure (7.39 MPa) are released to reduce pressure to atmospheric conditions. While three depressurizers are illustrated herein, it should be understood that any sequenced pressure drop is contemplated herein which avoids a complete drop in pressure in one operation and the time period between pressure drops is in the range of 10-30 minutes, e.g. 10 minutes, 11 minutes, 12 minutes, etc., up to 30 minutes.

The extraction efficiency may be influenced by pressure, temperature and $CO_2$ flow rate and extraction time. For example, the temperature may be between 20° C. and 5.8 MPa (subcritical $CO_2$ liquid) to 31.1° C. and 7.39 MPa (supercritical $CO_2$). Preferred extraction times may be in the range of 10 minutes to 2.0 hours. The $CO_2$ flow itself may preferably be 5 to 10 times (in mass) of the counter current flow of macroalgae. Such factors may therefore all be conveniently adjusted to optimize the extraction efficiency.

What is claimed is:

1. A process for extracting lipids from microalgae cells comprising:

supplying living microalgae cells containing lipids to an extractor and extracting said lipids from said cells with liquid and/or supercritical carbon dioxide medium, wherein said liquid $CO_2$ is at or above 216.5° K and 517 kPa and wherein said supercritical $CO_2$ is at or above 304.3° K (31.1° C.) and 7.39 MPa;

wherein said cells are exposed to liquid and/or supercritical carbon dioxide for said extraction in said extractor, and said pressure of said liquid and/or supercritical carbon dioxide is reduced to atmospheric conditions in sequence wherein successive portions of said pressure are released using two or more depressurizers; and wherein said microalgae cells are viable after said extraction process.

2. The process of claim 1 wherein said $CO_2$ supercritical pressure is reduced in a first depressurizer to 4-5 MPa followed by reduction in a second depressurizer to a pressure of 2-3 MPa and followed by reduction in a third depressurizer to atmospheric pressure.

3. The process of claim 1 wherein an organic solvent is combined with said liquid and/or supercritical $CO_2$.

4. The process of claim 3 wherein the organic solvent increases the relative polarity of said medium.

5. The process of claim 4 wherein said organic solvent has a dielectric constant of greater than 1.5.

6. The process of claim 3 wherein said organic solvent is selected from the group consisting of an organic alcohol or organic ether.

7. The process of claim 1 wherein prior to said extraction said living cells are coated with a porous silica gel coating.

8. The process of claim 1 wherein prior to said extraction said living cells are coated with a porous hydrophilic polymer.

9. The process of claim 7 wherein said coating is present on said cells at a thickness of 0.1 μm to 1.0 μm.

10. The process of claim 8 wherein said coating is present on said cells at a thickness of 0.1 μm to 1.0 μm.

11. The process of claim 1 wherein said extraction is configured as a continuous extraction wherein said viable microalgae cells once extracted are further cultivated and again extracted to remove said lipids.

12. The process of claim 1 wherein a photosensitive material is added to said living microalgae cells to promote cellular photosynthesis.

13. The process of claim 12 wherein said photosensitive material is added to said living microalgae cells is at a level of 500 ppm to 3000 ppm.

14. The process of claim 12 wherein said photosensitive material is selected from the group consisting of chlorophyll, iron porphyrins, algae pigments and organic dyes.

15. The process of claim 7 wherein said porous silica gel coating has pore sizes in the range of 5 Angstroms to 3,000 Angstroms.

16. The process of claim 8 wherein said hydrophilic polymer has pore sizes in the range of 0.5 nanometers to 300 nanometers.

* * * * *